US007946667B2

(12) United States Patent
Schweers et al.

(10) Patent No.: US 7,946,667 B2
(45) Date of Patent: May 24, 2011

(54) FRICTIONAL DRAWER SLIDE DAMPENER

(76) Inventors: Dennis John Schweers, Burnaby (CA); Martin J. Forbes, Richmond (CA)

( * ) Notice: Subject to any disclaimer, the term of this patent is extended or adjusted under 35 U.S.C. 154(b) by 560 days.

(21) Appl. No.: 11/987,179

(22) Filed: Nov. 28, 2007

(65) Prior Publication Data

US 2009/0134757 A1 May 28, 2009

(51) Int. Cl.
*A47B 95/00* (2006.01)

(52) U.S. Cl. ..... 312/333; 312/334.44

(58) Field of Classification Search ..... 312/330.1, 312/333, 334.44–334.47, 334.1, 334.7; 5/922, 5/603, 656
See application file for complete search history.

(56) References Cited

U.S. PATENT DOCUMENTS

| | | | | | |
|---|---|---|---|---|---|
| 1,798,876 | A | * | 3/1931 | Geimer | 312/334.1 |
| 1,969,749 | A | | 8/1934 | Harsh | |
| 3,160,448 | A | * | 12/1964 | Abernathy et al. | 384/23 |
| 3,679,275 | A | | 7/1972 | Fall et al. | |
| 3,746,418 | A | * | 7/1973 | Barber, Jr. | 312/334.45 |
| 3,966,273 | A | | 6/1976 | Hagen et al. | |
| 4,028,949 | A | | 6/1977 | Hagen | |
| 4,440,461 | A | * | 4/1984 | Powell et al. | 312/334.8 |
| 5,123,721 | A | | 6/1992 | Seo | |
| 5,549,377 | A | * | 8/1996 | Krivec | 312/334.8 |
| 5,795,044 | A | | 8/1998 | Trewall, Jr. et al. | |
| 5,951,132 | A | | 9/1999 | Cirocco | |
| 6,079,719 | A | * | 6/2000 | Tisbo et al. | 280/47.35 |
| 6,155,661 | A | | 12/2000 | O'Neil et al. | |
| 6,193,336 | B1 | * | 2/2001 | Jencka | 312/9.57 |
| 6,250,730 | B1 | | 6/2001 | Roth et al. | |
| 6,341,702 | B1 | * | 1/2002 | MacKelvie | 211/40 |
| 6,471,634 | B1 | | 10/2002 | Dykes et al. | |
| 6,619,769 | B1 | * | 9/2003 | Hammonds et al. | 312/330.1 |
| 6,733,097 | B2 | * | 5/2004 | Kim et al. | 312/333 |
| 2004/0236175 | A1 | * | 11/2004 | Boone et al. | 600/22 |
| 2006/0061243 | A1 | * | 3/2006 | Van Loon et al. | 312/330.1 |
| 2006/0066190 | A1 | * | 3/2006 | Hay | 312/333 |

* cited by examiner

*Primary Examiner* — Darnell M Jayne
*Assistant Examiner* — Andres Gallego
(74) *Attorney, Agent, or Firm* — Bull, Housser & Tupper LLP

(57) ABSTRACT

A dampened drawer within a drawer frame includes frame and drawer slide rails cooperating together with the drawer supported in the frame for longitudinal sliding movement of the drawer slide rail with respect of the frame slide rail. A first strip of material is attached to the frame slide rail and a second strip of material is attached to the drawer slide rail with the strips contacting each other in frictional engagement. The frictional engagement is determined so as to prevent longitudinal sliding movement of the drawer slide rail with respect to the frame slide rail when a force less than a predetermined force is applied to the drawer in any position of the drawer with respect to the frame over the entire range of longitudinal sliding movement of the drawer slide rail with respect to the frame slide rail.

14 Claims, 14 Drawing Sheets

FRICTIONAL DRAWER SLIDE DAMPENER

BACKGROUND OF THE INVENTION

This invention relates to a dampened drawer which prevents inadvertent movement of the drawer when in any position with respect to the drawer frame, when a force less than a predetermined force is applied to the drawer. The invention further relates to a dampened drawer configured for uniform frictional engagement or alternatively uniform force required to move the drawer, throughout the entire range of movement of the drawer with respect to the drawer frame.

SUMMARY OF THE INVENTION

Drawer slides are designed to support a drawer within a drawer frame and permit the drawer to slide outwardly from the frame when moved. Track systems comprised of two or more slide rails are employed to undertake this task. One part of the track system is attached to the drawer frame and the other part is attached to the drawer. The two parts communicate with one another to permit longitudinal telescoping movement of the drawer within the frame as the drawer is moved with respect to the frame to access the contents of the drawer.

Drawer slides provide telescoping longitudinal sliding movement between the two parts of the track system with a minimum level of friction to facilitate the opening and closing of the drawer by a user. While such drawer slides are useful in facilitating movement of a drawer within its frame, problems can arise when that type of drawer slide is employed in an environment which moves, such as a drawer in an infant care apparatus or infant carrier, similar to that disclosed in U.S. Pat. No. 6,471,634, the contents of which are hereby incorporated by reference in their entirety. When a movable apparatus containing a drawer, such as in an infant care apparatus, is moved, the drawer can open inadvertently. This is particularly problematic when this type of apparatus is moved around a corner thereby applying lateral centrifugal forces on a drawer which opens laterally. This can cause inadvertent opening of the drawer resulting in difficulties for the user as the open drawer may interfere with surrounding obstacles as the infant carrier is moved.

Modifications to drawer slides have been devised to prevent inadvertent opening of a drawer unless sufficient force is applied on the drawer to open the drawer. This usually involves the use of a detent or similar structural component which retains the drawer in a closed position, until sufficient force to overcome the detent or other similar structural component is applied to the drawer. However such a device, while retaining the drawer in a fully closed position, is not useful in preventing further opening of a partially-opened drawer or controlling such movement when the drawer is moved in any position other than a fully closed position. If the detent retaining force is overcome not only will the drawer move from a fully closed position, the drawer could then move rapidly into other open positions upon application of a much lesser force on the drawer. Also, if the detent is mistakenly not engaged there is insufficient force to maintain the drawer in a static position, causing the drawer to open inadvertently when lateral forces are applied to the drawer.

As a consequence, there is a need for a drawer dampener which prevents a drawer from sliding, in any position between its fully open and fully closed positions, when a force less than a predetermined force is applied on the drawer. That predetermined force is large enough to prevent inadvertent movement of the drawer within its frame as a movable apparatus or support member such as an infant carrier containing such a drawer is moved about. This includes when it is moved in a semi-circular or other curved path whereby centrifugal forces are applied laterally on the drawer which would otherwise cause the drawer to move with respect to its frame. That is, the frictional engagement of the first and second drawer dampening strips is sufficient to prevent movement of the drawer with respect to the frame when a force less than a predetermined force is applied to the drawer.

The predetermined force is sufficient to prevent longitudinal sliding movement of the drawer with respect to the frame when the movable support member is moved in any position of the drawer with respect to the frame, over the entire range of longitudinal sliding movement of the drawer slide rail with respect to the frame slide rail.

The predetermined force is defined as a force threshold that is the minimum force which must be exceeded to move the drawer in at least part of its range of positions with respect to the drawer frame. That is, a force less than the predetermined force will not move the drawer irrespective of the drawer's position with respect to the frame. Such a drawer dampener requires application of a force greater than the predetermined force on the drawer to move it. This results in the drawer being moved in a more controlled manner.

There is also a need for a dampened drawer configured so that the level of frictional engagement of the drawer with respect to its frame remains uniform over the entire range of longitudinal movement of the drawer slide rail with respect to the frame slide rail.

In an embodiment of the invention, a dampened drawer is provided which is movable with respect to a drawer frame of a movable support member, and which includes a frame slide rail fastened to the drawer frame and a drawer slide rail fastened to the drawer. The frame slide and drawer slide rails co-operate together to support the drawer in the frame for longitudinal sliding movement of the drawer with respect to the frame. A first strip of material is connected to the frame and a second strip of material is connected to the drawer, the second strip contacting at least a portion of the first strip in frictional engagement in a region of contact. The frictional engagement of the first and second strips is sufficient to prevent movement of the drawer with respect to the frame when a force less than a predetermined force is applied to the drawer. The predetermined force is the maximum force that can be applied without causing a longitudinal sliding movement of the drawer with respect to the frame when the movable support member is in any position of the drawer with respect to the frame over the entire range of longitudinal sliding movement of the drawer slide rail with respect to the frame slide rail.

In another embodiment of the invention, the strips are configured so that the level of frictional engagement of the strips remains uniform over the entire range of longitudinal sliding movement of the drawer slide rail with respect to the frame slide rail.

In another embodiment, the first strip has an increased surface area in a region adjacent to the first end of the first strip decreasing to a region adjacent to the second end of the first strip and the second strip has an increased surface area in a region adjacent to the first end of the second strip decreasing to a region adjacent to the second end of the second strip; the first end of one of the strips being in alignment with the second end of the other of the strips when the drawer is in a closed position.

In a further embodiment, the first strip is of increased cross-sectional thickness in a region adjacent to the first end of the first strip decreasing to a region adjacent to the second end of the first strip and the second strip is of increased cross-sectional thickness in a region adjacent to the first end of the second strip decreasing to a region adjacent to the second end of the second strip, the first end of one of the strips being in alignment with the second end of the other of the strips when the drawer is in a closed position.

In another embodiment, the strips are oriented with respect to one another in an X shape when viewed from a direction perpendicular to the planes defined by the slide rails.

In yet a further embodiment, the entire surface area of the first strip remains in contact with the second strip over the entire range of longitudinal sliding movement of the drawer slide rail with respect to the frame slide rail.

In an alternate embodiment, the drawer includes a closed position with respect to the frame wherein the contents of the drawer are inaccessible and two open positions, opening in different directions, wherein the contents of the drawer are accessible. Optionally, the two open positions may be in opposite directions. In a further embodiment, the strips are configured to provide uniform frictional engagement of the strips over the entire range of longitudinal sliding movement of the drawer slide rail with respect to the frame slide rail. In a further embodiment, each of the strips has an increased surface area in a region adjacent to each end of the strips as compared to a central region of the strips. In a further embodiment, each of the strips is of increased cross-sectional thickness in a region adjacent each end of the strips as compared to a central region of the strips. In another embodiment, the strips are oriented with respect to one another in an X shape when viewed from a direction perpendicular to the planes defined by the slide rails. In a further embodiment, the first strip comprises two sub-strips of material in spaced relationship with one another in the direction of movement of the slide rails, oriented with respect to the second strip so that a constant surface area of the two sub-strips contacts the second strip, to define the region of contact, over the entire range of longitudinal sliding movement of the drawer slide rail with respect to the frame slide rail.

In yet another embodiment of the invention, the strips comprise a plurality of extensions extending in a perpendicular direction from a plane defined by the slide rails, the extensions of the first strip being in frictional engagement with adjacent extensions of the second strip such that adjacent extensions of the strips are in frictional engagement which together define the region of contact. The frictional engagement of the strips may optionally include a plurality of regions of contact each defining a plane which is perpendicular to the plane defined by the slide rails.

In further embodiments, the first strip may be mounted on the frame slide rail and the second strip may be mounted on the drawer slide rail. The strips may be in parallel alignment over the entire range of longitudinal sliding movement of the drawer slide rail with respect to the frame slide rail. One or both of the strips may have a thickness of resiliently deformable material.

In still further embodiments, the frictional engagement between the first and second strips of material may be determined by the thickness of the material and the positioning of the drawer slides with respect to one another in order to apply pressure on the strips of material between the slides corresponding to the level of frictional engagement required to prevent longitudinal sliding movement of the drawer slide rail with respect to the frame slide rail unless a force greater than the predetermined force is applied on the drawer. The predetermined force may be at least 7.8 Newtons, or may be between 7.8 and 27.4 Newtons or between 11.7 and 27.4 Newtons. The frame slide rail may comprise a pair of parallel, spaced frame slide members, with the frame slide members co-operating with the drawer slide rail to support the drawer and with the first and/or second strips mounted between the slide members. The dampened drawer may also comprise a detent retaining the drawer in a closed position until a detent force sufficient to overcome the detent and move the drawer is applied on the drawer, the detent force being greater than the predetermined force.

In another embodiment, the predetermined force is the minimum force required in order to prevent the longitudinal sliding movement of the drawer with respect to the frame when the movable support member is moved in any position of the drawer with respect to the frame, over the entire range of longitudinal sliding movement of the drawer slide rail with respect to the frame slide rail.

DETAILED DESCRIPTION OF PREFERRED EMBODIMENT(S)

Figure 1:
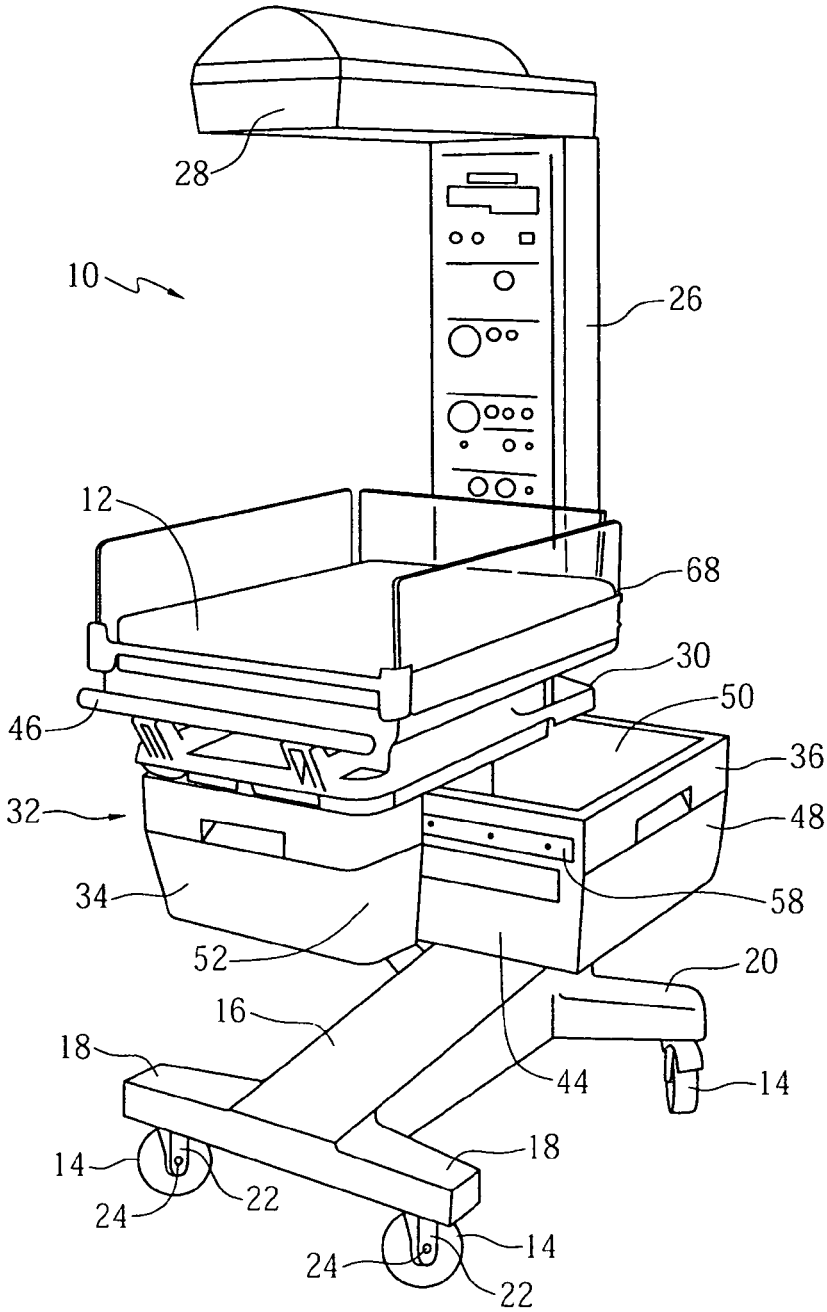
FIG. 1 is a perspective view of an infant carrier which has been fitted with the frictional drawer slide dampener of an embodiment of the subject invention.

Referring initially to FIG. 1, infant carrier 10, acting as a movable support member, is shown. Carrier 10 includes infant bed 12 for supporting an infant (not shown) and a set of four wheels 14 for supporting carrier 10 and enabling carrier 10 to be moved about a support surface by manually pushing carrier 10. Infant carrier 10 is commonly used to transport infants within a hospital environment from one location to another.

Wheels 14 of carrier 10 support lower frame 16. Frame 16 includes left and right front wheel extension members 18 as well as left and right rear wheel extension members 20 which connect wheels 14 to frame 16. A pair of spaced opposed wheel support members 22 support axles 24 to permit rotation of wheels 14 about axles 24. Frame 16 supports vertical tower 26 extending upwardly adjacent the tower end 68 of bed 12 to support radiant heater 28 used to warm an infant positioned on bed 12.

Vertical tower 26 also supports horizontal frame support 30 which extends horizontally from tower 26 to extend over member 16. Bed 12 is positioned above support 30 which supports bed 12 in a secure position connected to tower 26 which, in turn, is connected to lower frame 16. Storage region 32 is connected to frame support 30 and positioned below support 30. Storage region 32 includes outer drawer 34 and laterally mounted drawer 36. Laterally mounted drawer 36 has been dampened and is sometimes referred to as a dampened drawer. A lateral horizontal handle 46 extends horizontally along the outer end of support 30 to provide a handle for manually grasping and moving carrier 10 on wheels 14.

Figure 2:
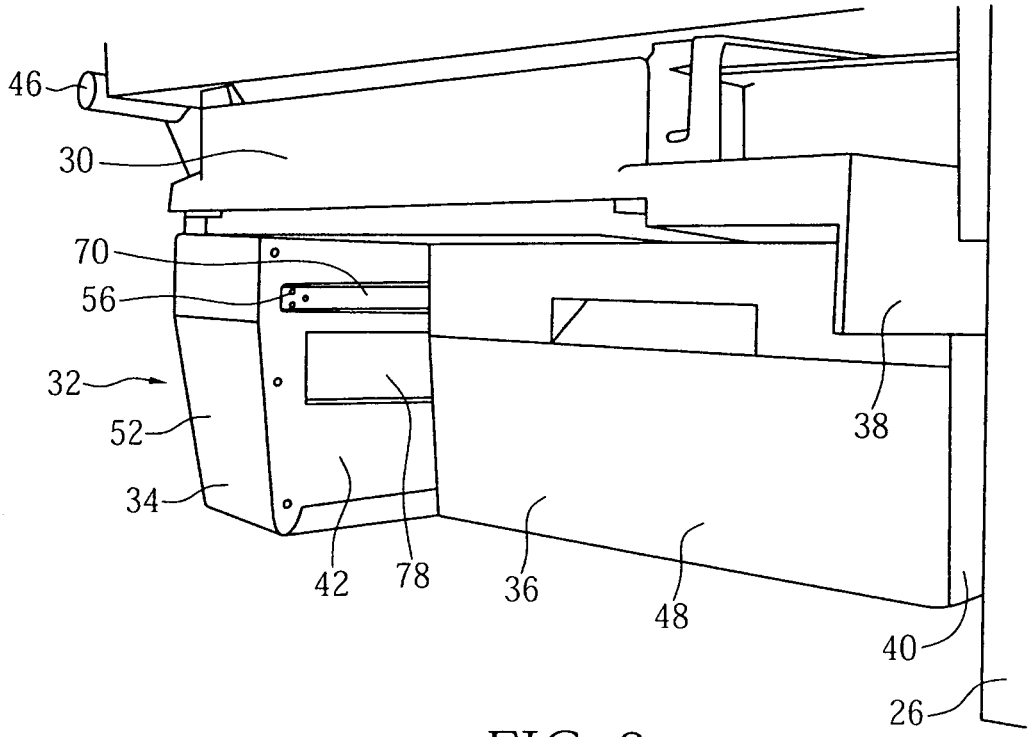
FIG. 2 is a close-up perspective view of a dampened drawer within a drawer frame of the infant carrier of FIG. 1.

Drawer 36 includes right face 48 and an opposed parallel spaced left face 49 (FIG. 4) generally similar or identical in shape to right face 48. Drawer 36 further includes forward side 44 (FIG. 1) and rear side 40 (FIG. 2). Right face 48, left face 49, rear side 40 and forward side 44 define cavity 50 which is used to store various medical equipment and supplies for use while attending to an infant on bed 12. Drawer 34 is positioned adjacent member 42 (FIG. 2), with member 42 adjacent forward side 44 (FIG. 1) of lateral drawer 36. Referring to FIG. 2, horizontal frame support 30 includes vertical flange 38 position adjacent tower 26 on one side of flange 38 and positioned adjacent rear side 40 of drawer 36 on the other side of flange 38.

Laterally mounted drawer 36 is slideingly attached to member 42 adjacent outer drawer 34 and to flange 38 for sliding movement in a lateral direction perpendicular to the longitudinal axis of carrier 10. Drawer 36 is positioned so that right face 48 is aligned with adjacent right side face 52 of outer drawer 34 when drawer 36 is in a closed position whereby cavity 50 is covered at the top by support 30. In the closed position, the contents of cavity 50 are inaccessible and are protected from inadvertently spilling from cavity 50 by support 30. As seen best in FIG. 4, when in the closed position, right face 48 is generally contiguous to right side face 52 of outer drawer 34 and left face 49 is generally contiguous with left side face 53 of outer drawer 34. As a consequence, in the closed position, drawer 36 is centered generally in alignment with right side face 52 and left side face 53 of outer drawer 34 and positioned directly beneath frame support 30.

Drawer 36 is slideable laterally, that is in a direction perpendicular to the longitudinal axis of carrier 10, from the said closed position to an open position as depicted in FIG. 1, whereby the contents of cavity 50 are accessible for use. In addition, drawer 36 can also slide laterally from the closed position to an open position in the opposite direction to that depicted in FIG. 1, as depicted in FIG. 2, whereby the contents of cavity 50 are accessible for use on the opposite side of bed 12. In this manner, the contents of cavity 50 are accessible from either side of carrier 10, at the discretion of the hospital personnel attending to an infant on bed 12.

Member 42, horizontal frame support 30 and vertical flange 38 act together as a drawer frame with drawer 36 movable with respect to the drawer frame.

Figure 3:
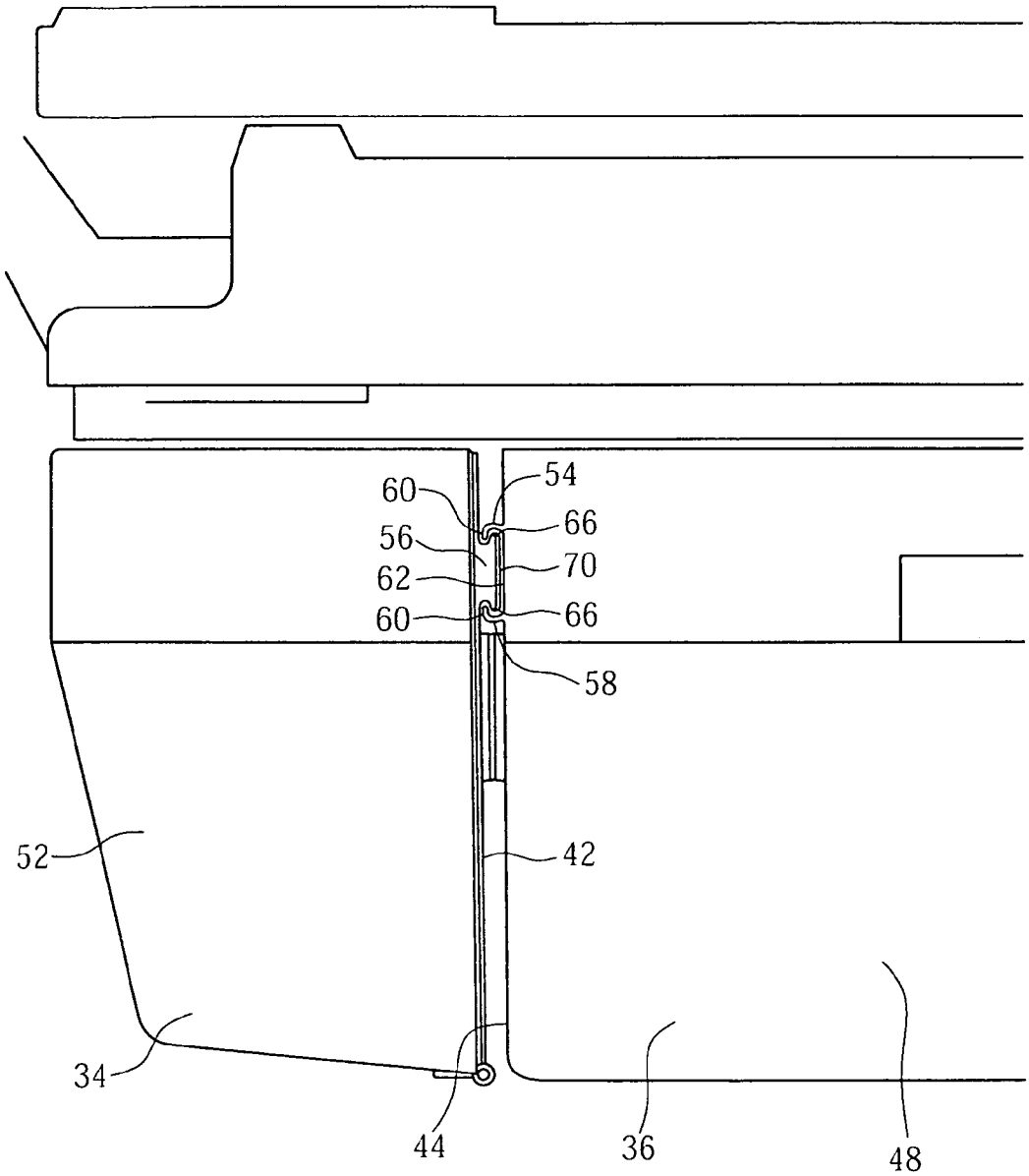
FIG. 3 is a partial side view of a segment of the dampened drawer within the drawer frame of FIG. 2.
Figure 4:
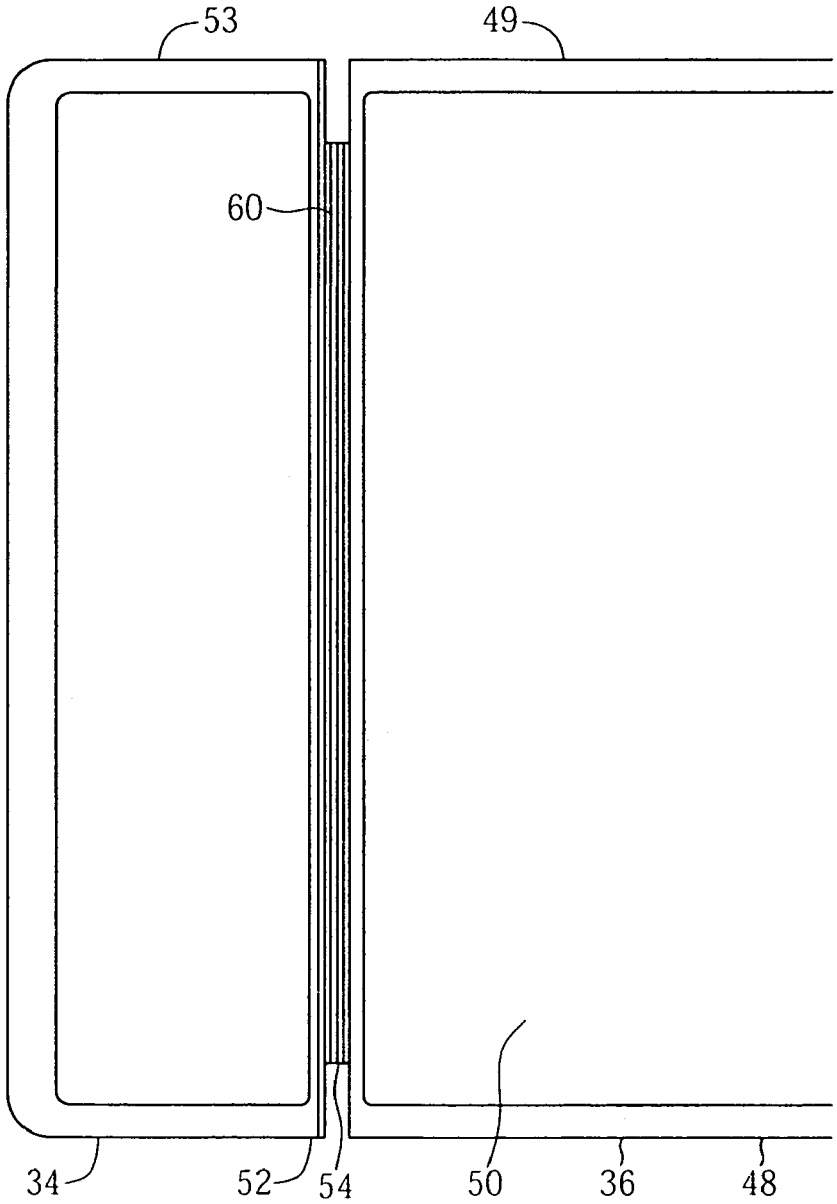
FIG. 4 is a partial top view of the segment of FIG. 3.

Drawer 36 is supported on carrier 10 for sliding movement between the closed position to either one of the open positions described above by means of a pair of horizontal track systems 54, as best seen in FIGS. 3 and 4. Track systems 54 are of conventional design with inner slide member 56, also referred to herein as a frame slide rail, slidable in a horizontal direction within, and slidingly constrained by, outer slide member 58, also referred to herein as a drawer slide rail, best seen in FIG. 6. One track system 54 is positioned between forward side 44 of drawer 36 and member 42 adjacent drawer 34, with outer slide member 58 (FIG. 6) attached to forward side 44 of drawer 36 and inner slide member 56 (FIG. 2) attached to member 42 adjacent drawer 34. The other track system 54 is positioned between rear side 40 of drawer 36 (FIG. 2) and the side of flange 38 adjacent drawer 36, with outer slide member 58 (or drawer slide member) attached to rear side 40 of drawer 36 and inner slide member 56 (or frame slide member) attached to the side of flange 38 adjacent drawer 36.

Figure 6:
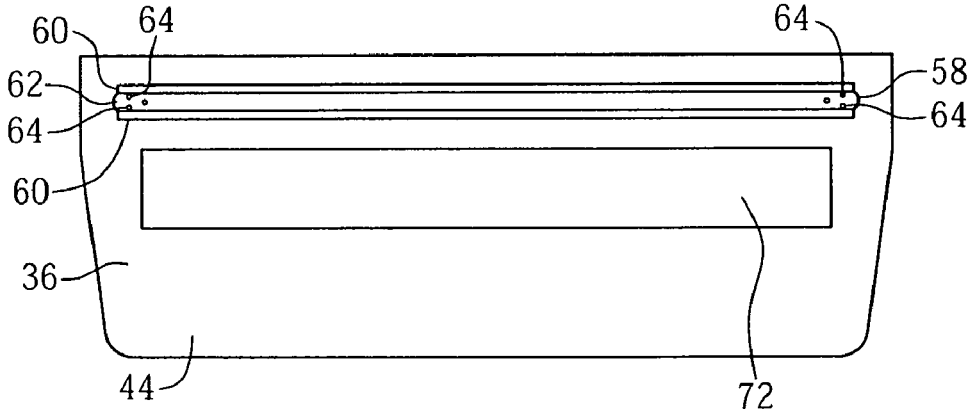
FIG. 6 is a side view of the dampened drawer of FIG. 1.
Figure 7A:
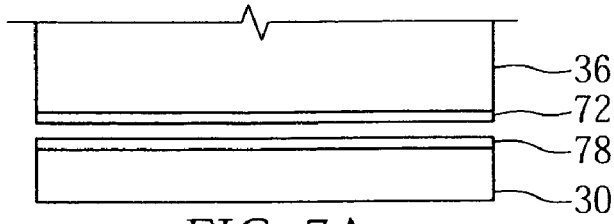
FIGS. 7(*a*), (*b*), (*c*) and (*d*) are simplified top and side views of an alternate embodiment of the subject invention.
Figure 7B:
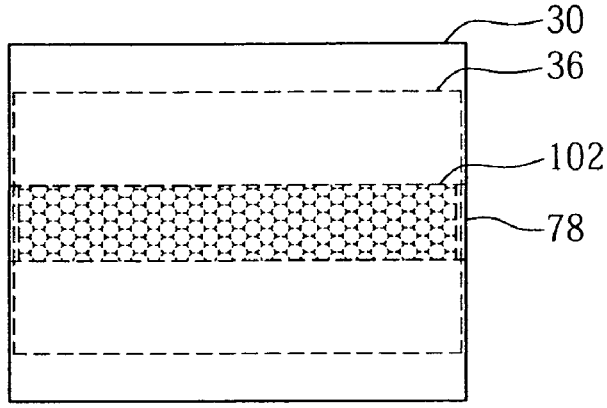
Figure 7C:
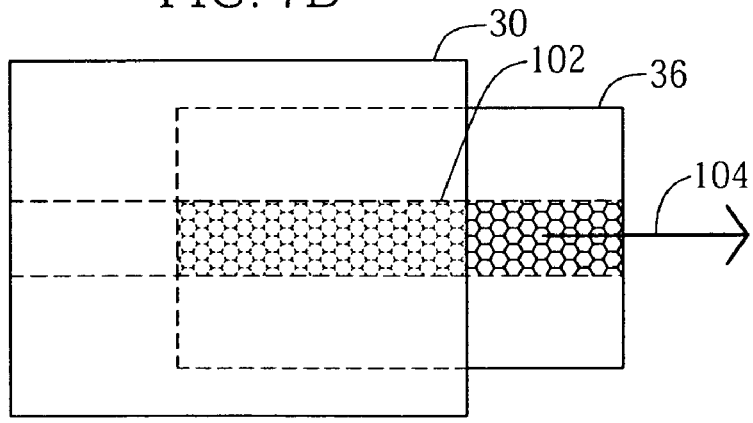
Figure 7D:
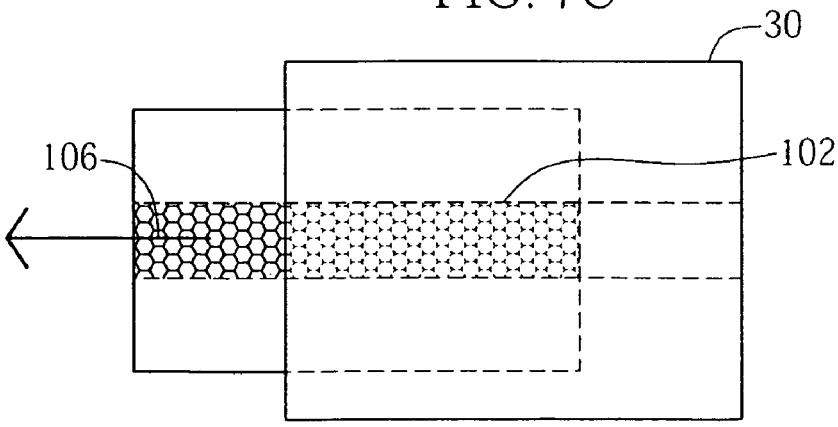

Referring to FIGS. 3 and 6, outer slide member 58 is comprised of a pair of parallel outwardly facing U-shaped upper and lower rails 60 connected together by an inner flat longitudinal base member 62. Base member 62 is rigidly attached to member 42 adjacent drawer 34 by means of screws 64. Inner slide members 56 comprise corresponding upper and lower track members 66 (FIG. 3) connected by a base member 70, track members 66 slidingly engage with, and are constrained for horizontal sliding movement by, rails 60.

Figure 5:
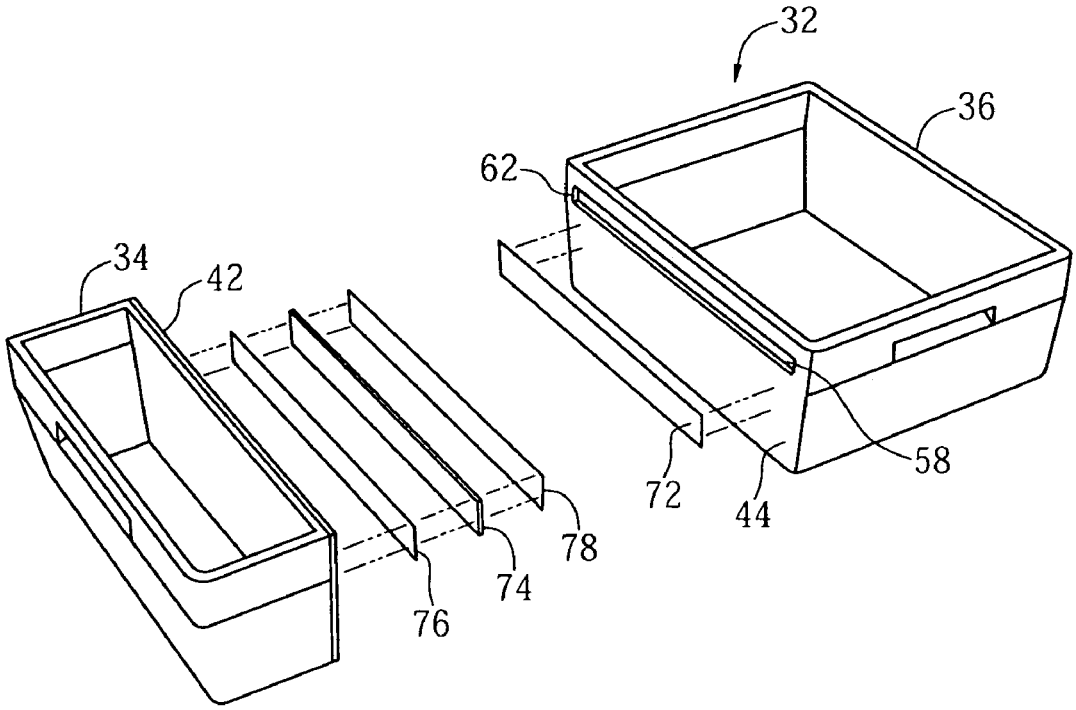
FIG. 5 is an exploded view of a dampened drawer and adjacent frame of the infant carrier of FIG. 1.

Referring to FIG. 5, storage region 32 is shown in an exploded view with outer drawer 34 adjacent laterally mounted drawer 36. A first strip of material 72, in this particular embodiment a strip of the loop or pile portion of a hook and loop fastening system commonly known by the trademark VELCRO®, is fastened to forward side 44 of lateral drawer 36 by means of appropriate adhesive. First strip 72 is generally of rectangular longitudinal shape extending substantially the length of outer slide member 58, parallel with and below outer slide member 58.

Spacer 74 is attached to member 42 by means of double sided tape layer 76. Spacer 74 is generally rectangular in shape of substantially the same outer dimensions as first strip 72. Spacer 74 is positioned on member 42 below inner slide member 56 attached to member 42 (FIG. 2) so that when outer slide member 58 attached to forward side 44 is slidingly engage within inner slide member 56 attached to member 42, spacer 74 is aligned with first strip 72. A second strip of material 78, of similar dimensions as spacer 74 and first strip 72, is secured to spacer 74 by means of suitable adhesive. In this particular embodiment second strip 78 comprises another strip of the loop portion of a hook and loop fastening system commonly known by the trademark VELCRO®. Second strip 78 is thereby aligned with first strip 72. Furthermore, the thickness of spacer 74 is pre-selected to provide suitable frictional engagement between first strip 72 and second strip 78 sufficient to prevent inadvertent movement of drawer 36, irrespective of its position with respect to frame support 30, when lateral forces are applied to drawer 36 caused by movement of carrier 10 in a curved direction (as when rounding a corner), but not so great as to prevent drawer 36 from being moved by a user in normal use.

The force required to overcome the detent and open the drawer from the detent closed position, sometimes herein referred to as the "break out force" was measured at between 34 and 39 Newtons for a drawer having a pair of 16 inch long Accuride® drawer sliders as slide members 56 and 58. Slide members 56 and 58 include detents (not shown) to keep drawer 36 from freely moving from its center fully closed position. Once the drawer is displaced from the detent, the force required to move the drawer was measured to be between 0.5 and 2.0 Newtons to move the drawer from rest at locations over its entire 28 cm range of motion.

The measurement was repeated with the installation of the pile-on-pile friction drawer runners. The frictional material comprised 2 strips of 2 inch wide and 13 inch long Velcro® pile (i.e. loop portion). One strip of Velcro pile 72 was applied to side 44 of drawer 36, the opposing strip of Velcro® pile 78 was applied to member 42. The two strips 72 and 78 are juxtaposed so as to allow the Velcro® pile strips 72 and 78 to rub one upon the other to produce a frictional force when drawer 36 is moved.

The force required to overcome the detent and open drawer 36 from the detent closed position is approximately 43.15 Newtons. The force required to move drawer 36 from rest at any location over the 28 cm of motion was equal to or in excess of 11.8 Newtons. The force required to move the drawer is generally highest just out of the detent closed position, and lowest near the end of motion. The force measurements are not entirely consistent and will vary from one measurement to the next, for the same displacement position of the drawer.

The following are examples of approximate force measurements to move a drawer with a pair of 16 inch long Accuride® drawer slides with the pair of Velcro® pile strips of material 72 and 78:

43.15 Newtons force to overcome detent (i.e. the "break out force")

| |
|---|
| 20.6 to 27.5 Newtons @ 1 cm displacement |
| 18.6 to 23.5 Newtons @ 2 cm displacement |
| 16.7 to 23.5 Newtons @ 3 cm displacement |
| 15.7 to 23.5 Newtons @ 4 cm displacement |
| 15.7 to 24.5 Newtons @ 5 cm displacement |
| 14.7 to 24.5 Newtons @ 6 cm displacement |
| 15.7 to 24.5 Newtons @ 7 cm displacement |
| 19.6 to 24.5 Newtons @ 8 cm displacement |
| 19.6 Newtons @ 9 cm displacement |
| 21.6 Newtons @ 10 cm displacement |
| 21.6 Newtons @ 11 cm displacement |
| 19.6 Newtons @ 12 cm displacement |
| 19.6 Newtons @ 13 cm displacement |
| 20.6 Newtons @ 14 cm displacement |
| 18.6 to 23.5 Newtons @ 15 cm displacement |
| 17.6 Newtons @ 16 cm displacement |
| 16.7 Newtons @ 17 cm displacement |
| 14.7 Newtons @ 18 cm displacement |
| 13.7 to 14.7 Newtons @ 19 cm displacement |
| 14.7 Newtons @ 20 cm displacement |
| 23.5 Newtons @ 21 cm displacement |
| 15.7 Newtons @ 22 cm displacement |
| 13.7 Newtons @ 23 cm displacement |
| 11.8 to 13.7 Newtons @ 24 cm displacement |
| 11.8 Newtons @ 25 cm displacement |
| 14.7 to 19.6 Newtons @ 26 cm displacement |
| 16.7 Newtons @ 27 cm displacement |

The measurements were taken with a Libra Accuweigh Model T-20 spring scale (0-10 kg scale with 0.1 kg increments) and converted to force measured in Newtons based on:

$$\text{Force (in Newtons)} = \text{Mass (in kg)} \times 9.80616 \text{ m/second squared}$$

In order to adequately prevent the inadvertent movement of drawer 36 as discussed above, a force which moves drawer 36 with respect to frame support 30 at any position in the range of movement of drawer 36, should be no less than 7.8 Newtons using the measuring system described above. This amount of force is the "predetermined" force for this embodiment and is sufficient to prevent inadvertent movement of drawer 36 with respect to frame support 30. A force of about 27.4 Newtons will still allow drawer 36 to be moved at any position in the range of longitudinal sliding movement, as required by a user, without having to exert excessive force to move drawer 36. A more preferred range of predetermined force is between 11.7 and 27.4 Newtons in this embodiment.

First strip 72 and second strip 78 are of uniform thickness throughout their region of contact with one another. The frictional engagement between first strip 72 and second strip 78 is consistent throughout the region of contact between strip 72 and 78 over the entire range of sliding movement of drawer 36 between its closed position and the two open positions described above. While not shown, a pair of strips of material corresponding to strips 72 and 78, and a spacer corresponding to spacer 74 is positioned between side 40 (FIG. 2) and the side of flange 38 adjacent to drawer 36.

Strips 72 and 78 and a spacer 74 of suitable thickness between adjacent member 42 and forward side 44 prevents the movement of drawer 36 with respect to frame support 30 on application of any force less than or equal to the predetermined force on drawer 36 while permitting that movement in at least part of the range of positions when a force greater than the predetermined force is applied to the drawer. The predetermined force being the force which must be exceeded to over come the frictional engagement between strips 72 and 78, in order to move drawer 36 with respect to frame support 30 in at least part of the range positions of drawer 36 over the range of sliding movement of drawer 36 between its closed position and the two open positions described above when infant carrier 10 (the movable support member) is moved. This includes the force which may be required to overcome a "detent" or other impediment which may retain a drawer in a fully closed position, such a detent or other impediment not being a part of this embodiment. If such a detent or other impediment is present, the breakout force required to overcome that detent plus the frictional forces of the strips or other impediment should also be equal to or in excess of the predetermined force. Preferably, the force required to overcome the detent plus the frictional forces of the strips and move drawer 36 is greater than the predetermined force.

It should be understood that due to other factors acting on the drawer 36 at different positions of drawer 36 between its fully open end fully closed positions, at some positions of the drawer with respect to the frame support 30 a force just in excess of the predetermined force may move drawer 30 with respect to frame support 36. At other positions, a much greater force may be required. The predetermined force does not define a force that, when exceeded at any force level, will cause drawer 36 to move at all of its positions with respect to frame support 30. Rather it is a level of force that prevents movement of drawer 36 with respect to frame support 30, at any position of drawer 36 with respect to frame support 30. This ensures that drawer 36 will not move inadvertently with respect to frame support 30 no matter what the position of drawer 36 with respect to frame support 30, as infant carrier 10 is moved.

In the present embodiment, the thickness of spacer 74, first strip 72 and second strip 78 are uniform throughout the length of those components so that the frictional engagement between strips 72 and 78 is consistent throughout the region of contact of strips 72 and 78. As well the thickness of spacer 74, strips 72 and 78 provides sufficient frictional engagement between strips 72 and 78 to prevent longitudinal sliding motion of drawer 36 with respect to drawer frame 30 along the entire range of movement of drawer 36 for any applied force less than the predetermined force. Further, and as an option, in this embodiment, strips 72 and 78 may be positioned in close proximity to outer slide member 58 and inner slide member 56 respectively, which ensures a close register of first strip 72 with second strip 78 over the entire surface area of those strips. Positioning strip 72 and 78 in close proximity to slide members 58 and 56 further ensures that lateral movement of strips 72 and 78 with respect to one another (that is movement toward or away from one another) is minimized due to the alignment of rails 60 within track members 66. This further serves to provide a more uniform level of force which is consistently at or in excess of the predetermined force required to move drawer 36 between its closed position and either of the two open positions as the distance between strips 72 and 78 is maintained at a constant level.

In an alternate embodiment, first strip 72 may be positioned to overlie base member 62 of outer slide member 58 and second strip 78 may be positioned to overlie base member 70 (FIG. 2) of inner slide member 56. When inner slide member 56 is positioned within outer slide member 58 (FIG. 3) for sliding movement therein, first strip 72 engages second strip 78 to provide frictional engagement between the strips. In this embodiment, spacer 74 may not be required, as the combined thickness of base members 62 and 70 may be sufficient to provide adequate frictional engagement between first and second strips 72 and 78 particularly when base members 62 and 70 of suitable thickness are selected.

Referring to FIG. 7, alternate embodiments of the invention are depicted generally in a simplified manner. FIG. 7(*a*) is a top view with drawer 36 in a closed position. However, it should be noted that while strips 72 and 78 are shown spaced apart from one another, when in actual use they are in frictional engagement with one another in region of contact 102 (FIG. 7(*b*)).

Referring to FIG. 7(*b*), the drawer of FIG. 7(*a*) is shown in a closed position in a side view. Region of contact 102 extends substantially the full length of drawer 36 when drawer 36 is in the closed position, as depicted in FIGS. 7(*a*) and 7(*b*).

Referring to FIGS. 7(*c*) and 7(*d*), it can be seen that the region of contact decreases as drawer 36 is moved in a longitudinal sliding motion with respect to frame support 30 in the direction of arrow 104 of FIG. 7(*c*) or arrow 106 of FIG. 7(*d*). The surface area of the region of contact 102 shown in FIGS. 7(*c*) and 7(*d*) is less than the surface area of region of contact 102 shown in FIGS. 7(*a*) and 7(*b*). Furthermore, the surface area of region of contact 102 is progressively smaller as drawer 36 is moved in a longitudinal sliding manner in the direction of either arrow 104 or arrow 106 further outwardly from horizontal frame support 30. The effect of this is that the force required to move drawer 36 in the direction of arrows 104 or 106 decreases as drawer 36 is moved outwardly from horizontal frame support 30. As a consequence, the predetermined force must be determined for these embodiments based on a minimum region of contact 102 when drawer 36 is moved outwardly with respect to horizontal frame support 30 its maximum distance in either the direction of arrow 104 or the direction of arrow 106. This will ensure that the predetermined force is sufficient to prevent longitudinal sliding movement of drawer 36 with respect to horizontal frame support 30 when carrier 10 is moved, in any position of drawer 36 with respect to frame support 30, over the entire range of longitudinal sliding movement of drawer inner slide member 56 with respect to outer slide member 58.

Alternatives

In some cases drawer 36 may be relatively loosely fit within frame support 30 due to slide members 56 and 58 being loosely connected together in a manner that permits lateral movement of members 56 and 58 with respect to one another. This can result in drawer 36 moving from side to side, that is in a direction perpendicular to the direction of longitudinal sliding movement of drawer 36, perpendicular to the direction of arrow 104 and arrow 106 of FIGS. 7(*c*) and 7(*d*). This can cause the frictional engagement between strips 72 and 78 in the region of contact 102 between them to vary causing variations in the force required to move drawer 36 with respect to frame support 30.

Figure 8:
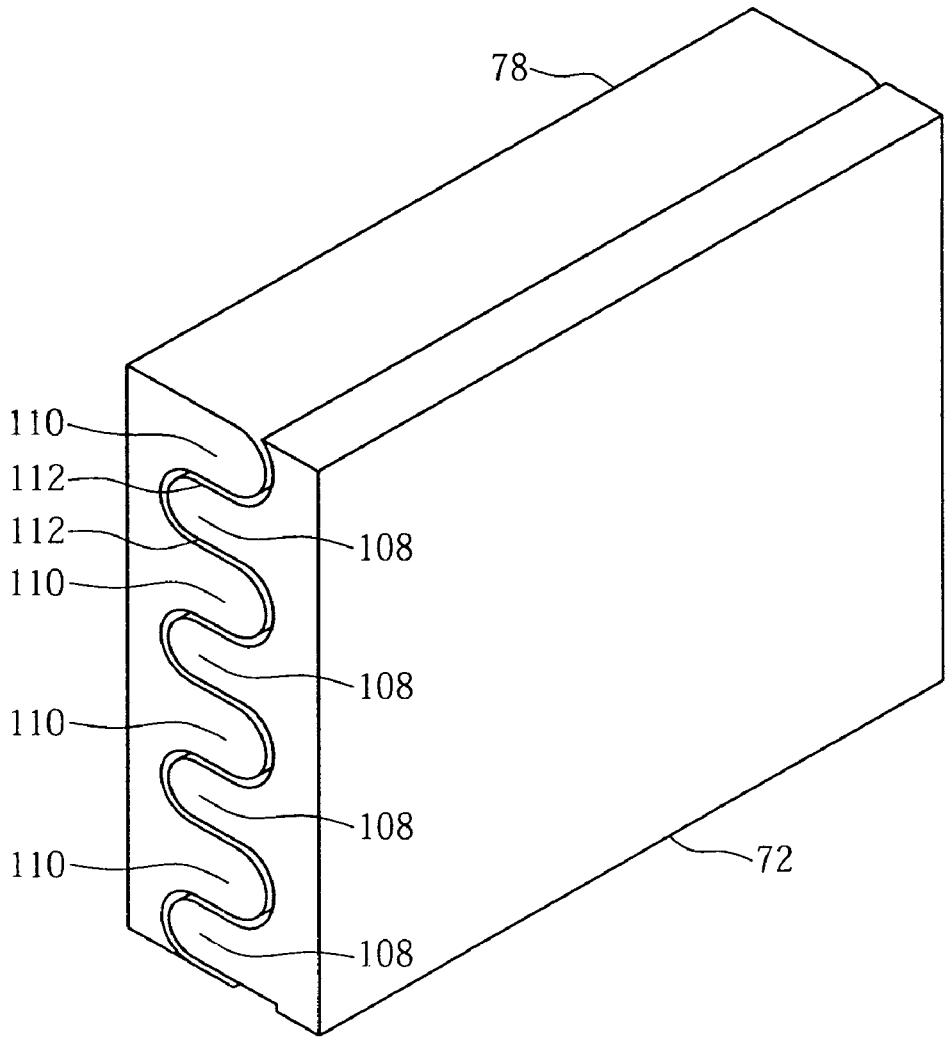
FIG. 8 is a perspective close-up view of a section of a pair of strips of an alternate embodiment of the subject invention.

In order to adequately deal with this type of side-to-side movement of drawer 26, first and second strips of material 72 and 78 can be oriented such that the region of contact 102 comprises one or more surface areas lying in a plane perpendicular to arrows 104 and 106, and perpendicular to the plane defined by forward side 44 and member 42. FIG. 8 depicts one possible embodiment designed to overcome the problem of a loosely fitting drawer 36. First strip of material 72 includes a plurality of outwardly extending fingers 108 which mesh with and are interleaved with alternate fingers 110 of second strip of material 78. Fingers 108 and 110 are dimensioned in a manner which provides sub-regions of contact between adjacent fingers 108 and 110. As can be seen in FIG. 8, a substantial part of each sub-region of contact 112 is perpendicular to the plane defined by member 42 and forward side 44 and the plane defined by members 56 and 58. Sub-regions 112 will remain in frictional engagement over a substantial part of their surface areas even where drawer 36 may be moved in a side-to-side direction perpendicular to member 42 and forward side 44, that is in a direction parallel with the plane of fingers 108 and 110. As before, fingers 108 and 110 are configured such that sufficient frictional engagement exists to ensure that drawer 36 cannot move with respect to horizontal frame support 30 away of its longitudinal sliding motion, until a force greater than the predetermined force is applied to drawer 36.

Figure 9:
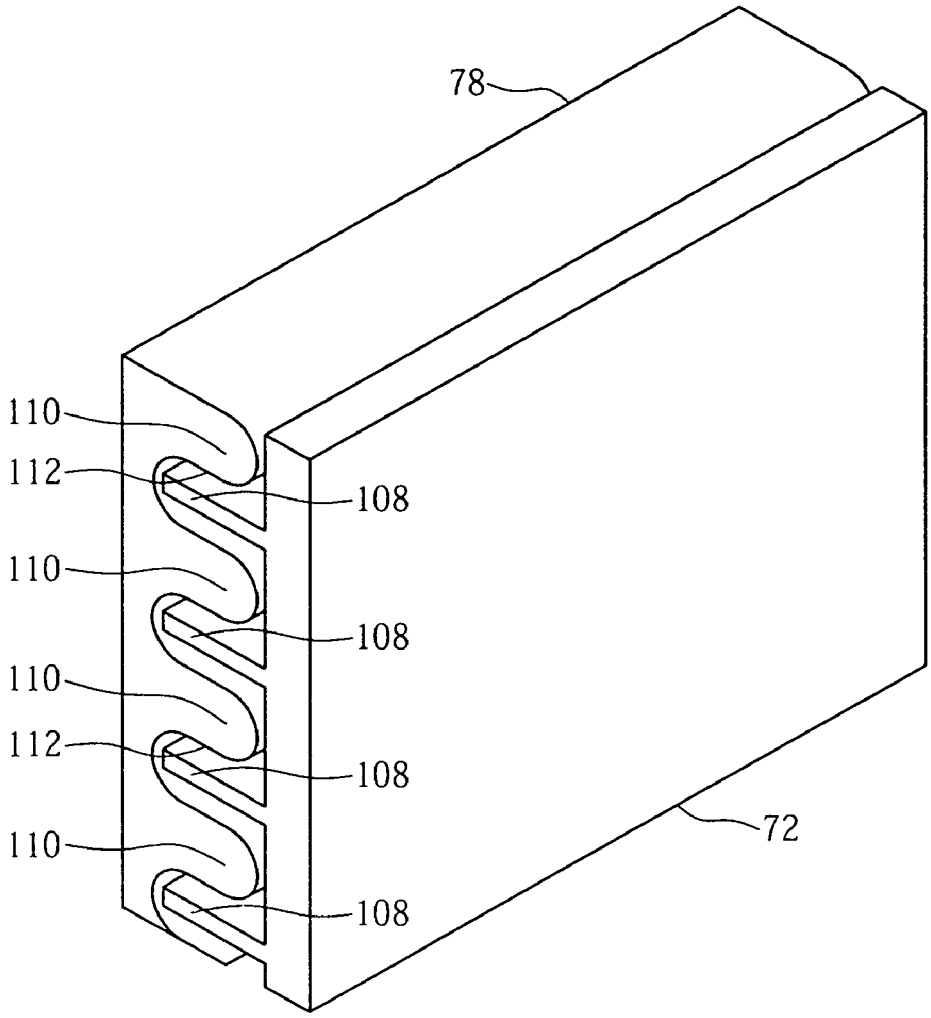
FIG. 9 is a perspective close-up view of a section of a pair of strips of an alternate embodiment of the strips of FIG. 8.
Figure 10A:
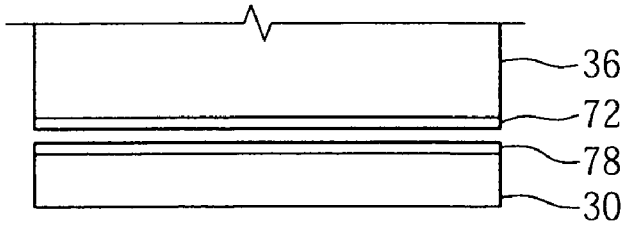
FIGS. 10(*a*), (*b*), (*c*) and (*d*) are simplified top and side views of an alternate embodiment of the subject invention.
Figure 10B:
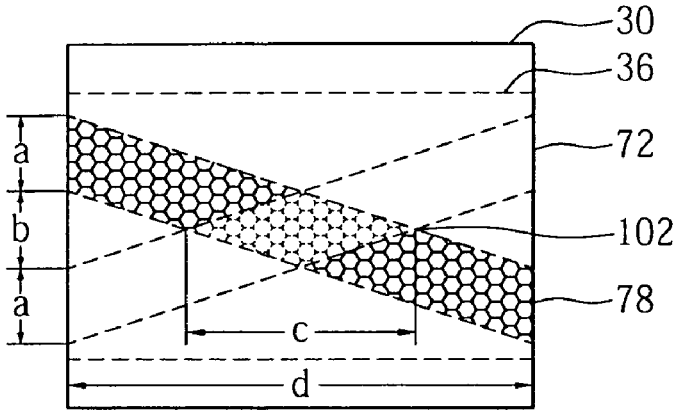
Figure 10C:
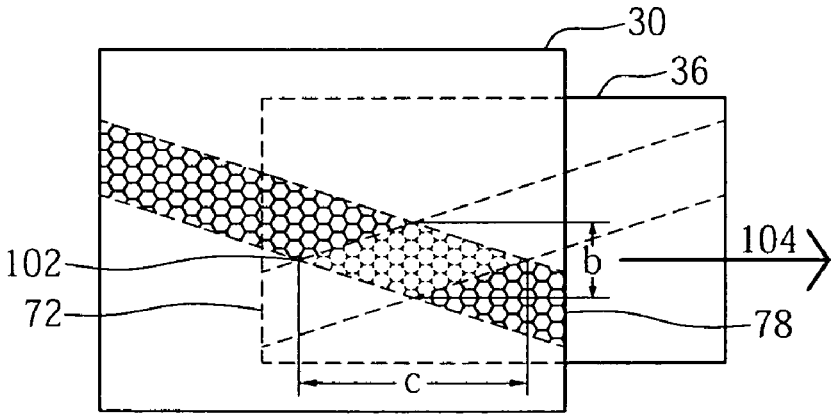
Figure 10D:
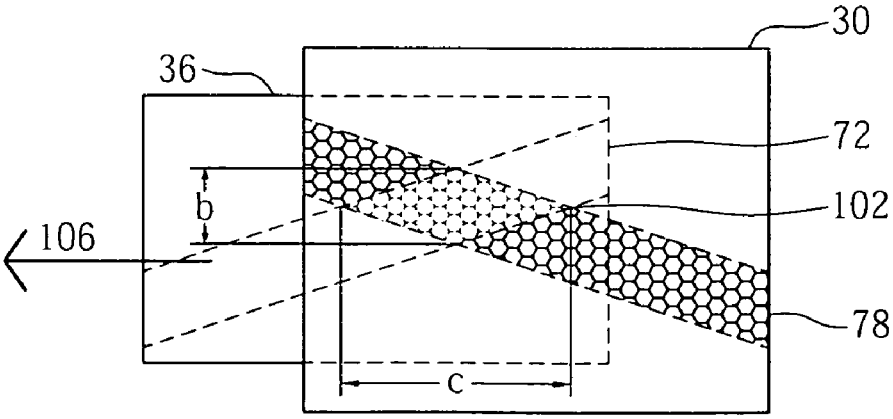

Referring to FIG. 9, fingers 108 may be shaped in a variety of ways in order to provide sub-regions of contact 112 which when combined, form region of contact 102. In FIG. 8, fingers 108 and 110 are generally of equivalent shape with a semi-circular end. FIG. 9 depicts an alternate embodiment in which fingers 108 are of a generally rectangular cross-sectional shape with fingers 110 shaped similar to fingers 110 of FIG. 8.

In an alternate embodiment, strips 72 and 78 are configured so that the level of frictional engagement of strips 72 and 78 remain generally uniform over the entire range of longitudinal sliding movement of inner slide member 56 with respect to outer slide member 58. FIG. 10 depicts an alternate embodiment with such a configuration.

As depicted in FIG. 10(*b*), strips 72 and 78 are oriented with respect to one another to form an X-shape when viewed from a direction perpendicular to the planes defined by inner and outer slide members 56 and 58. This forms a diamond-shaped region of contact 102 with a length equal to "c" and a width equal to "b" as depicted in FIG. 10(*b*) when drawer 36 is in its closed position.

Referring to FIG. 10(*c*), if drawer 36 is moved outwardly with respect to frame support 30 in a longitudinal sliding motion in the direction of arrow 104, it can be seen that region of contact 102 has the same surface area as compared to that of FIG. 10(*c*). Diamond-shape region of contact 102 remains the same length "c" and width "b" (and consequently is of the same surface area) as when drawer 36 is in its closed position depicted in FIG. 10(*b*).

Similarly, referring to FIG. 10(*d*), if drawer 36 is moved with respect to frame support 30 in the direction of arrow 106, triangular-shaped region of contact 102 retains the same surface area as when drawer 36 is in its closed position depicted in FIG. 10(*b*) as well as when drawer 36 is moved in the direction of arrow 104 as depicted in FIG. 10(*c*). The size of diamond-shaped region of contact 102 of FIG. 10 remains constant over the entire range of longitudinal sliding movement of drawer 36 with respect to frame support 30, that is a constant length "c" and width "b". In this manner, strips 72 and 78 are configured so that the surface area of region of contact 102 is the same over the entire range of longitudinal sliding movement of drawer inner slide member 56 with respect to outer slide member 58. This configuration requires application of at least a force in excess of the predetermined force in order to move drawer 36 with respect to frame support 30 throughout that entire range of movement of drawer 36 with respect to support 30. As before, the predetermined force is sufficient to prevent longitudinal sliding movement of drawer 36 with respect to horizontal frame support 30 when carrier 10 is moved.

It should be further noted with respect to FIG. 10(*a*), that first strip 72 is spaced from second strip 78 for purposes of more readily discerning the thickness of each of strip 72 and 78. In this embodiment, the cross-sectional area remains constant throughout the length of strips 72 and 78. In use, however, strips 72 and 78 would be positioned adjacent one another in sufficient frictional engagement to prevent movement of the drawer with respect to the horizontal frame support 30 unless a force greater than the predetermined force is applied to drawer 36.

Figure 11A:
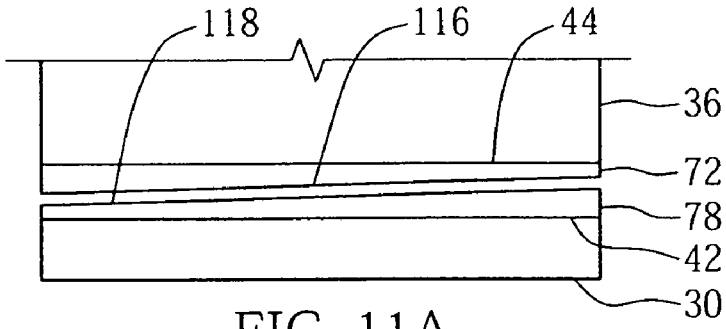
FIGS. 11(*a*), (*b*) and (*c*) are simplified top and side views of an alternate embodiment of the subject invention.
Figure 11B:
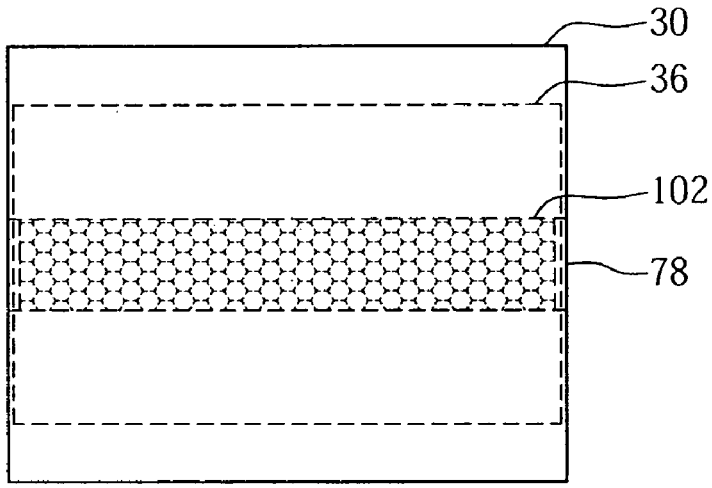
Figure 11C:
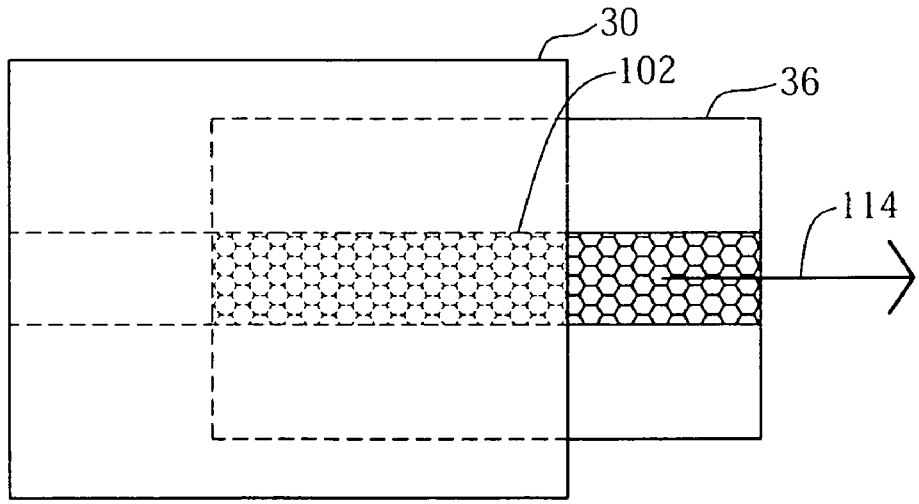
Figure 12A:
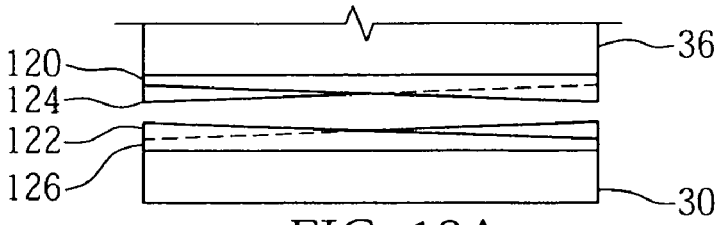
FIGS. 12(*a*), (*b*), (*c*) and (*d*) are simplified top and side views of an alternate embodiment of the subject invention.
Figure 12B:
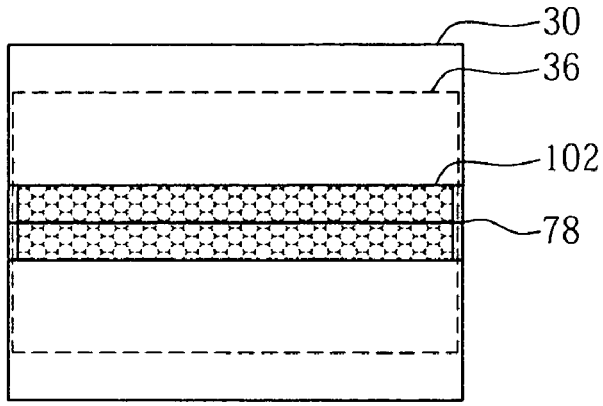
Figure 12C:
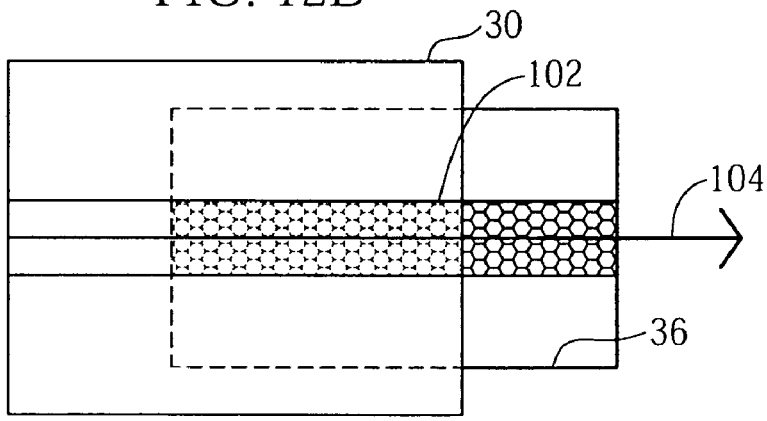
Figure 12D:
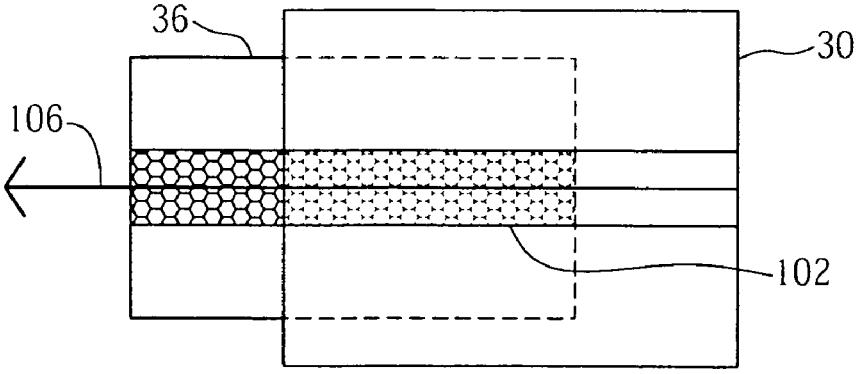

A further alternate embodiment is depicted in FIG. 11. This embodiment provides strips 72 and 78 which are configured so that the level of frictional engagement of the strips 72 and 78 in the region of contact 102 increases progressively as the drawer is moved outwardly with respect to the frame, the level of increased force per unit area sufficient to require the application of uniform force to move the drawer with respect to the frame over the entire range of longitudinal sliding movement of inner slide member 56 with respect to outer slide member 58. Referring to FIG. 11(*a*), strips 72 and 78 are depicted spaced apart from one another although in use they would be adjacent one another in frictional engagement sufficient to require a force greater than the predetermined force to move drawer 36 with respect to frame support 30. In this embodiment, strips 72 and 78 have a progressively increasing cross-sectional area to form two wedge-shaped strips 72 and 78 in opposite configuration when viewed from above, as depicted in FIG. 11(*a*). That is the thicker end of strip 72 is adjacent the thinner end of strip 78 and the thicker end of strip 78 is adjacent the thinner end of strip 72. The embodiment shown in FIG. 11 would be particularly suited for drawer 36 which opens only in one direction, that being the direction of arrow 114 as depicted in FIG. 11(*c*).

The angle of each of the contact surfaces 116 and 118 as compared to the planes defined by forward side 44 and member 42 is such that, as the region of contact 102 decreases as drawer 36 is moved outwardly, the degree of frictional engagement between strips 72 and 78 increases proportionally. This configuration permits the application of a consistent level of force in excess of the predetermined force on drawer 36 in order to move drawer 36 with respect to frame support 30 throughout that entire range of movement of drawer 36 with respect to support 30.

As seen in FIG. 11(*c*) as compared to FIG. 11(*b*), as drawer 36 is moved outwardly in the direction of arrow 114, the surface area of region of contact 102 becomes progressively smaller as drawer 36 is moved progressively in an outward direction. However, as drawer 36 is moved progressively outwardly in the direction of arrow 114 the cross sectional area of the strips 72 and 78 in frictional engagement increases proportionally to maintain the same required force to move drawer 36 with respect to support 30 in excess of the predetermined force.

FIG. 12 is an alternate embodiment, similar to the embodiment shown in FIG. 11, except that drawer 36 may be moved in either direction, that is in the direction of arrow 104 of FIG. 12(*c*) or arrow 106 of FIG. 12(*d*). Referring to FIG. 12(*a*), drawer 36 includes two strips of material, upper strip 120 and lower strip 122. Similarly, member 42 includes upper strip 124 and lower strip 126. Upper strip 120 faces upper strip 124 with the strips 120 and 124 in frictional engagement. Lower strip 122 faces lower strip 126 with those strips in frictional engagement. Strips 120, 122, 124 and 126 are each wedge-shaped when viewed from above to provide a higher level of frictional engagement as drawer 36 is moved outwardly with respect to frame support 30 in either direction depicted by arrow 104 of FIG. 12(*c*) and arrow 106 of FIG. 12(*d*).

Upper strips 120 and 124 are positioned with respect to one another such that the thicker end of strip 120 (that is the end with increased cross-section) faces the thinner end of strip 124 and such that the thinner end of strip 120 is positioned toward the direction of arrow 104. As drawer 36 is moved in the direction of arrow 104 progressively less surface area of strips 120 and 124 are in frictional engagement. At the same time a progressively increasing level of frictional engagement of the strips 120 and 124 occurs as the thicker parts of strips 120 and 124 are moved towards one another thereby increasingly engaging with one another as the drawer is moved outwardly in the direction of arrow 104. The angle of the planes defined by the outer face of strips 120 and 124 as compared to the planes defined by forward side 44 and member 42 is such that, as the region of contact 102 decreases as drawer 36 is moved outwardly, the degree of frictional engagement between strips 120 and 124 increases proportionally. This configuration permits the application of a consistent level of force in excess of the predetermined force on drawer 36 in order to move drawer 36 with respect to frame support 30 throughout that entire range of movement of drawer 36 with respect to support 30.

Lower strips 122 and 126 are positioned with respect to one another such that the thicker end of strip 126 faces the thinner end of strip 122 and such that the thinner end of strip 122 is positioned toward the direction of arrow 106. As drawer 36 is moved in the direction of arrow 106 progressively less surface area of strips 122 and 126 are in frictional engagement. At the same time a progressively increasing level of frictional engagement of the strips 122 and 126 occurs as the thicker parts of strips 122 and 126 are moved towards one another thereby increasingly engaging with one another as the drawer is moved outwardly in the direction of arrow 106. The angle of the planes defined by the outer face of strips 122 and 126 as compared to the planes defined by forward side 44 and member 42 is such that, as the region of contact 102 decreases as drawer 36 is moved outwardly, the degree of frictional engagement between strips 122 and 126 increases proportionally. This configuration permits the application of a consistent level of force in excess of the predetermined force on drawer 36 in order to move drawer 36 with respect to frame support 30 throughout that entire range of movement of drawer 36 with respect to support 30.

It should further be noted that when drawer 36 is moved in the direction of arrow 104 the frictional engagement of strips 122 and 126 become increasingly less as the thin end of strip 122 comes closer to the thin end of strip 126. At some point there will be no frictional engagement between strips 122 and 126 as drawer 36 is moved in the direction of arrow 104. Similarly when drawer 36 is moved in the direction of arrow 106 the frictional engagement of strips 120 and 124 become increasingly less as the thin end of strip 120 comes closer to the thin end of strip 124. At some point there will be no frictional engagement between strips 120 and 124 as drawer 36 is progressively moved in the direction of arrow 106.

Irrespective of the direction of movement of drawer 36 with respect to frame support 30, this configuration permits the application of a consistent level of force in excess of the predetermined force on drawer 36 in order to move drawer 36 with respect to frame support 30 throughout that entire range of movement of drawer 36 with respect to support 30.

As a further alternative, first strips (upper strips 120, 124) may be combined into one strip having a first end and a second end with an upper portion having an increased cross section at the first end with decreasing cross section when moving towards the second end and a lower portion having a decreased cross section at the first end with increasing cross section when moving towards the second end. Second strips (lower strips 12, 126) may also be combined into one strip having a first end and a second end with an upper portion having a decreased cross section at the first end with increasing cross section when moving towards the second end and a lower portion having an increased cross section at the first end with decreasing cross section when moving towards the second end. When the drawer is moved with respect to the frame in one direction the first end of the upper portion of the first strip moves closer to the second end of the upper portion of the second strip and when the drawer is moved with respect to the frame in the opposite direction the second end of the lower portion of the first strip moves closed to the first end of the lower portion of the second strip.

Figure 13A:
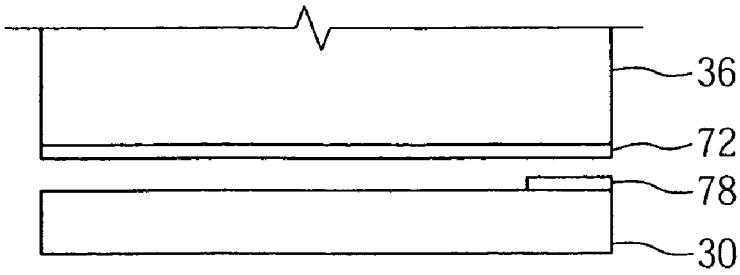
FIGS. 13(*a*), (*b*) and (*c*) are simplified top and side views of an alternate embodiment of the subject invention.
Figure 13B:
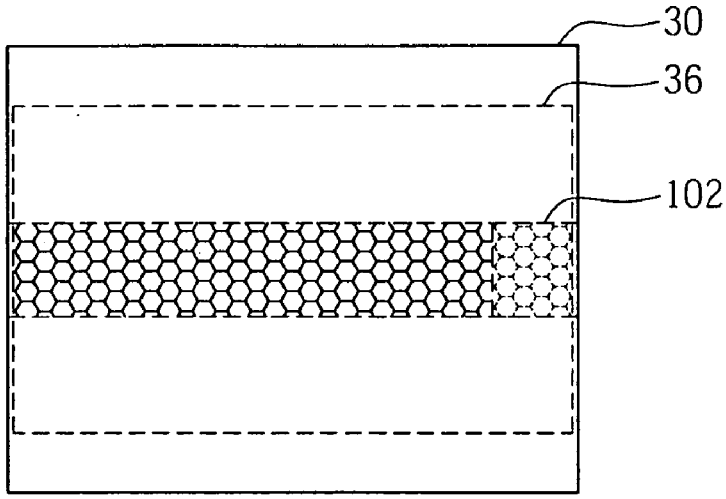
Figure 13C:
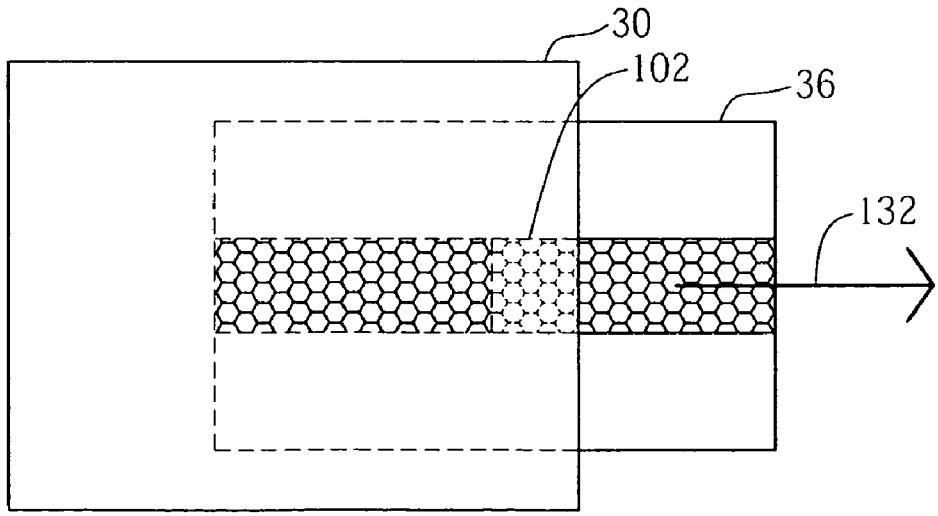
Figure 14A:
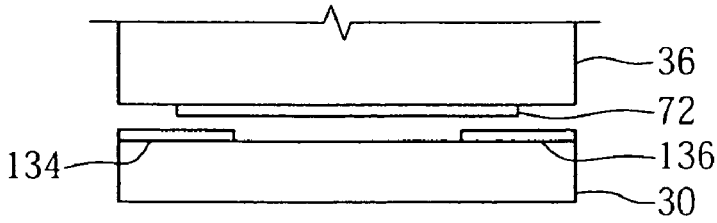
FIGS. 14(*a*), (*b*), (*c*) and (*d*) are simplified top and side views of an alternate embodiment of the subject invention.
Figure 14B:
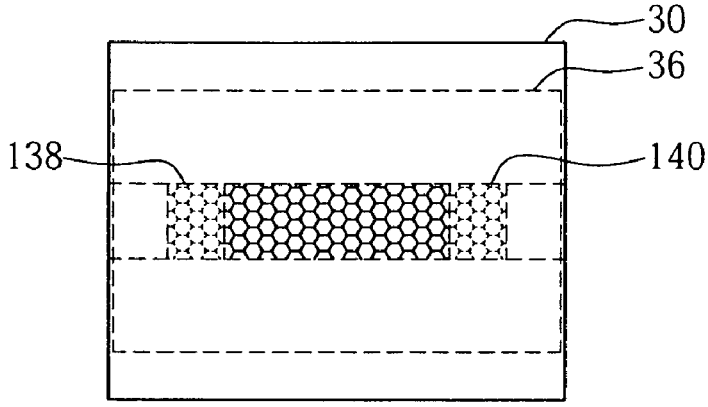
Figure 14C:
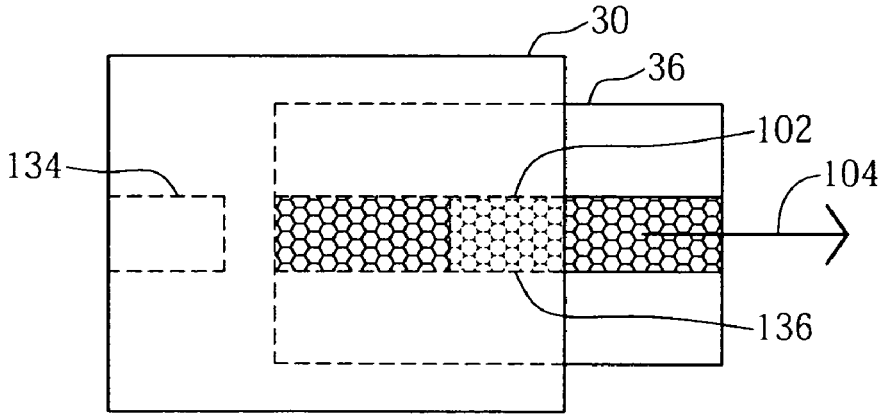
Figure 14D:
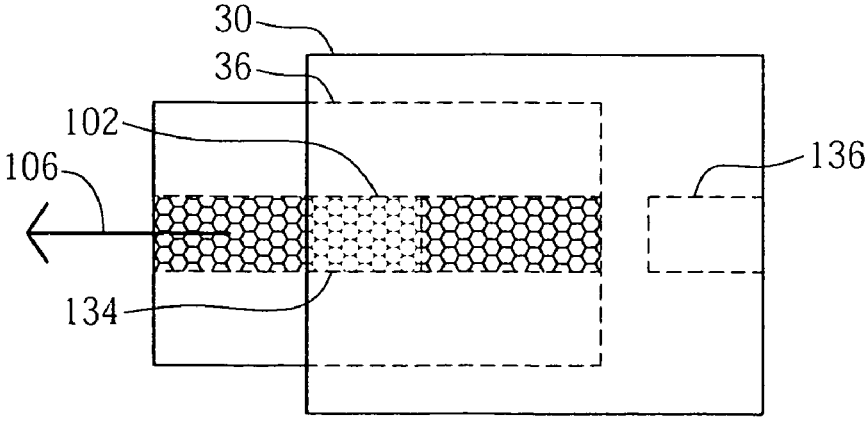

A further alternate embodiment is depicted in FIG. 13. While FIG. 13(*a*) depicts a top view with first strip 72 spaced from second strip 78, in use strips 72 and 78 are in frictional engagement in the manner described below. In this embodiment, strip 78 is significantly shorter than strip 72. Strip 72 extends generally the entire length of drawer 36, whereas strip 78 extends only partially in the longitudinal direction on member 42. Strip 72 is positioned adjacent the direction of drawer 36 movement which in this embodiment is in one direction, the direction of arrow 132. The length of inner strip 78 is such that the entire surface area 128 of strip 78 is in continuous contact with a portion of the surface area 130 of strip 72 over the entire range of longitudinal sliding movement of inner slide member 56 with respect to outer slide member 58 in the direction of arrow 132. As seen in FIG. 13(*b*), when drawer 36 is in its closed position, the region of contact 102 is equal to the entire surface area 128 of strip 78. Referring to FIG. 13(*c*), region of contact 102 remains equal to surface area 128 over the entire range of longitudinal sliding movement of inner slide member 56 with respect to outer slide member 58 in the direction of arrow 132. It should further be noted that when drawer 36 is in its fully extended open position, the region of contact 102 is still equal to the entire surface area 128 of strip 78 as drawer 36 is prevented from opening beyond a distance that will result in any part of the surface area of strip 78 moving out of frictional engagement with strip 72. In this embodiment strips 72 and 78 are configured so that the level of frictional engagement of strips 72 and 78 remains generally uniform over the entire range of longitudinal sliding movement of inner slide member 56 with respect to outer slide member 58.

Referring to FIG. 14, the alternate embodiment depicted is similar to that of FIG. 13 except that it is suitable for an infant carrier 10 in which drawer 36 may move in either direction of arrow 104 of FIG. 14(*c*) or 106 of FIG. 14(*d*). Referring to FIG. 14(*a*), strip 72 attached to drawer 36 is shorter in length than the length of drawer 36 and is centrally positioned so that no part of strip 72 is adjacent the ends of drawer 36. As well, in this embodiment, strips 134 and 136 replace strip 78 as the second strip of material. While FIG. 14(*a*) depicts strip 72, spaced apart from strips 134 and 136, in use strip 72 is in frictional engagement with strips 134 and 136 when drawer 36 is in its closed position as depicted in FIGS. 14(*a*) and 14(*b*).

Referring to FIG. 14(*b*), when drawer 36 is in its closed position, two regions of contact 138 and 140 are formed.

Referring to FIG. 14(*c*), as drawer 36 is moved in the direction of arrow 104 strip 72 moves progressively out of frictional engagement with strip 134 until it no longer is in frictional engagement with strip 72. At the same time, strip 136 moves into increasing frictional engagement with strip 72. The total surface area of strips 134 and 136 remains the same, as does the level of frictional engagement, throughout the movement of drawer 36 in the direction of arrow 104 over the entire range of longitudinal sliding movement in that direction. The two regions of frictional engagement 138 and 140 total the same surface area as surface area of one of strips 134 and 136. In this manner as drawer 36 is moved outwardly to a position where strip 134 is out of frictional engagement with strip 72, strip 136 remains in complete frictional engagement with strip 72 as drawer 36 is moved outwardly in the direction of arrow 104 to its fully open position.

Referring to FIG. 14(*d*), if drawer 36 is moved in the opposite direction, in the direction of arrow 106, strip 136 will move from full frictional engagement with strip 72 to progressively less frictional engagement with strip 72 as strip 134 moves into progressive increasing frictional engagement with strip 72. Eventually as drawer 36 is moved outwardly strip 136 will be completely out of frictional engagement with strip 136. At that point, strip 134 is in contact with strip 72 with the entire surface area of strip 134 remaining in frictional engagement with strip 72 as strip 72 moves farther away from strip 136 with movement of drawer 36 in the direction of arrow 106 to its fully open position in that direction.

It should be appreciated that the total surface area of the region of contact 102 split between strips 134 and 136 is the same throughout the entire range of movement of drawer 36 from its fully closed position as depicted in FIG. 14(*b*) in either direction of arrow 104 of FIG. 14(*c*) or arrow 106 of FIG. 14(*d*). In this manner, the level of frictional engagement of strips 134 and 136 with strip 72 remains uniform over the entire range of longitudinal sliding movement of inner slide member 56 with respect to outer slide member 58.

The foregoing alternate embodiments of the configuration of strips 72 and 78 and 134 and 136 are exemplary only. Other configurations could be developed such that either (i) the level of frictional engagement of those strips remains uniform over the entire range of longitudinal sliding movement of inner slide member 56 with respect to outer slide member 58; or (ii) the level of frictional engagement increases as drawer 36 is moved with respect to frame support 30 to permit the application of a consistent level of force in excess of the predetermined force on drawer 36 in order to move drawer 36 with respect to frame support 30 throughout that entire range of movement of drawer 36 with respect to support 30. Any force applied on drawer 36 less than the predetermined force will not cause movement of drawer 36 with respect to frame support 30.

The invention is not limited to infant carriers 10, but can also be used to dampen drawers in other applications where movement can cause inadvertent opening of a drawer and further is not limited to the loop portions of a VELCRO® type hook and loop fastening systems or any other type of fastening system. Any pair of strips of material, which need not be the same for each strip, with a suitable spacer, that provide suitable frictional engagement would be appropriate.

As will be apparent to those skilled in the art to which the invention is addressed, the present invention may be embodied in forms other than those specifically disclosed above, without departing from the spirit or essential characteristics of the invention. The particular embodiments of the invention described above and the particular details of the processes described are therefore to be considered in all respects as illustrative and not restrictive. The scope of the present invention is as set forth in the appended claims rather than being limited to the examples set forth in the foregoing description. Any and all equivalents are intended to be embraced by the claims.

We claim:

1. A dampened drawer movable with respect to a drawer frame of a movable support member, comprising:

(a) a frame slide rail fastened to the drawer frame, (b) a drawer slide rail fastened to the drawer, (c) the frame slide and drawer slide rails co-operating together to support the drawer in the frame for longitudinal sliding movement of the drawer with respect to the frame;

(d) a first strip of material connected to the frame;

(e) a second strip of material connected to the drawer, the second strip contacting at least a portion of the first strip in frictional engagement in a region of contact;

(f) the frictional engagement of the first and second strips preventing movement of the drawer with respect to the frame when a force less than a predetermined force is applied to the drawer, the predetermined force preventing free longitudinal sliding movement of the drawer with respect to the frame when the movable support member is moved in any position of the drawer with respect to the frame, over the entire range of longitudinal sliding movement of the drawer slide rail with respect to the frame slide rail;

wherein the level of frictional engagement of the strips increases progressively as the drawer is moved outwardly with respect to the frame so that the level of increased force per unit area is sufficient to require the application of uniform force to move the drawer with respect to the frame over the entire range of longitudinal sliding movement of the drawer slide rail with respect to the frame slide rail.

2. The dampened drawer as described in claim 1 wherein the predetermined force is a minimum force which is sufficient to prevent longitudinal sliding movement of the drawer with respect to the frame when the movable support member is moved in any position of the drawer with respect to the frame, over the entire range of longitudinal sliding movement of the drawer slide rail with respect to the frame slide rail.

3. The dampened drawer as described in claim 1 wherein the first strip is of increased cross-sectional thickness in a region adjacent a first end of the first strip decreasing to a region adjacent a second end of the first strip and the second strip is of increased cross-sectional thickness in a region adjacent a first end of the second strip decreasing to a region adjacent a second end of the second strip, the first end of one of the strips being in alignment with the second end of the other of the strips when the drawer is in a closed position, the drawer movable with respect to the frame in a manner which brings the first ends of each strip closer to one another as the drawer is moved progressively outwardly with respect to the frame.

4. The dampened drawer as described in claim 1 wherein:

(a) the first strip comprises a first end and a second end with an upper portion having an increased cross section at the first end with decreasing cross section when moving towards the second end and a lower portion having a decreased cross section at the first end with increasing cross section when moving towards the second end;

(b) the second strip comprises a first end and a second end with an upper portion having a decreased cross section at the first end with increasing cross section when moving towards the second end and a lower portion having an increased cross section at the first end with decreasing cross section when moving towards the second end;

whereby when the drawer is moved with respect to the frame in one direction the first end of the upper portion of the first strip moves closer to the second end of the upper portion of the second strip and when the drawer is moved with respect to the frame in the opposite direction the second end of the lower portion of the first strip moves closer to the first end of the lower portion of the second strip.

5. The dampened drawer as described in claim 4 wherein the drawer comprises a closed position with respect to the frame wherein the contents of the drawer are inaccessible and two open positions, opening in opposite directions, wherein the contents of the drawer are accessible.

6. The dampened drawer as described in claim 5 wherein each of the strips is of increased cross-sectional thickness in a region adjacent each end of the strips as compared to a central region of the strips.

7. The dampened drawer as described in claim 1 wherein the strips are in alignment over the entire range of longitudinal sliding movement of the drawer slide rail with respect to the frame slide rail.

8. The dampened drawer as described in claim 1 wherein one or both of the strips comprises a thickness of resiliently deformable material.

9. The dampened drawer as described in claim 1 wherein the frictional engagement between the first and second strips of material is determined by the thickness of the material and the positioning of the slide rails with respect to one another in order to apply pressure on the strips of material between the slide rails; the pressure corresponding to the level of frictional engagement required to prevent longitudinal sliding movement of the drawer slide rail with respect to the frame slide rail when a force less than the predetermined force is applied on the drawer.

10. The dampened drawer as described in claim 1 wherein the frame slide rail comprises a pair of parallel, spaced frame slide members, the frame slide members co-operating with the drawer slide rail to support the drawer and wherein the first strip is mounted between the slide members.

11. The dampened drawer as described in claim 1 wherein the drawer slide rail comprises a pair of parallel, spaced drawer slide members, the drawer slide members co-operating with the frame slide rail to support the drawer and wherein the second strip is mounted between the drawer slide members.

12. The dampened drawer as described in claim 10 wherein the drawer slide rail comprises a pair of parallel, spaced drawer slide members, the drawer slide members co-operating with the frame slide members to support the drawer and wherein the second strip is mounted between the drawer slide members.

13. The dampened drawer as described in claim 1 further comprising a detent retaining the drawer in a closed position when a detent force less than that required to overcome the detent and move the drawer is applied on the drawer, wherein the detent force is greater than or equal to the predetermined force.

14. A dampened drawer movable with respect to a drawer frame of a movable support member, comprising:

(a) a frame slide rail fastened to the drawer frame, (b) a drawer slide rail fastened to the drawer, (c) the frame slide and drawer slide rails co-operating together to support the drawer in the frame for longitudinal sliding movement of the drawer with respect to the frame;

(d) a first strip of material connected to the frame;

(e) a second strip of material connected to the drawer, the second strip contacting at least a portion of the first strip in frictional engagement in a region of contact;

(f) the frictional engagement of the first and second strips preventing movement of the drawer with respect to the frame when a force less than a predetermined force is applied to the drawer, the predetermined force preventing free longitudinal sliding movement of the drawer with respect to the frame when the movable support member is moved in any position of the drawer with respect to the frame, over the entire range of longitudinal sliding movement of the drawer slide rail with respect to the frame slide rail;

wherein the level of frictional engagement of the strips remains uniform over the entire range of longitudinal sliding movement of the drawer slide rail with respect to the frame slide rail, and wherein the strips are oriented with respect to one another in an X shape when viewed from a direction perpendicular to the planes defined by the slide rails.

* * * * *